United States Patent [19]

Nakamura et al.

[11] 4,413,612

[45] Nov. 8, 1983

[54] RED-HOT TYPE OIL BURNER

[75] Inventors: Kazuharu Nakamura; Motoki Matsumoto; Yoshimasa Tsuboi; Akinobu Kondo; Yoshitaka Kataoka, all of Nagoya, Japan

[73] Assignee: Toyotomi Kogyo Co., Ltd., Aichi, Japan

[21] Appl. No.: 255,001

[22] Filed: Apr. 16, 1981

[30] Foreign Application Priority Data

| | | | |
|---|---|---|---|
| Oct. 17, 1980 | [JP] | Japan | 55-148571[U] |
| Nov. 17, 1980 | [JP] | Japan | 55-164352[U] |
| Dec. 27, 1980 | [JP] | Japan | 55-190188[U] |
| Feb. 3, 1981 | [JP] | Japan | 56-14479[U] |

[51] Int. Cl.[3] ..... F24C 3/02

[52] U.S. Cl. ..... 126/92 C; 431/208; 431/210; 431/328

[58] Field of Search ..... 431/208, 210, 328; 126/92 R, 92 C, 92 AC, 92 B

[56] References Cited

U.S. PATENT DOCUMENTS

| | | | |
|---|---|---|---|
| 3,329,139 | 7/1967 | Vezzoli | 431/208 |
| 4,326,843 | 4/1982 | Smith | 431/328 |

FOREIGN PATENT DOCUMENTS

| | | |
|---|---|---|
| 40-33266 | 11/1965 | Japan . |
| 42-6859 | 11/1967 | Japan . |
| 49-8570 | 2/1974 | Japan . |
| 52-53006 | 12/1977 | Japan . |
| 53-11384 | 3/1978 | Japan . |
| 53-48333 | 11/1978 | Japan . |
| 54-14993 | 6/1979 | Japan . |

*Primary Examiner*—Carroll B. Dority, Jr.

*Attorney, Agent, or Firm*—Pollock, Vande Sande & Priddy

[57] ABSTRACT

A red-hot type oil burner capable of effectively accomplishing uniform vaporization of a fuel oil during the normal combustion operation. A heat transfer means is provided between a combustion chamber and a vaporization chamber to transmit a part of combustion heat to the vaporization chamber. The oil burner may be provided in a mixing chamber with a diffusion plate having a cutout to allow the ignition to be rapidly and safely effected. The oil burner may be also provided with a device for preventing the generation of a bad odor. There is also disclosed a red-hot type oil burner capable of surely confirming the completion of the igniting and fire extinguishing operations.

17 Claims, 7 Drawing Figures

RED-HOT TYPE OIL BURNER

BACKGROUND OF THE INVENTION

1. Field of the Invention

This invention relates to a red-hot type oil burner and more particularly to an oil burner of the type for burning a mixture of a vapor of a fuel oil such as kerosene and air on a surface of a combustion plate to render the combustion plate red-hot.

2. Description of the Prior Arts

Various red-hot type oil burners have been conventionally known which utilize a perforated ceramic plate as a combustion means. Such conventional red-hot type oil burner is typically constructed to have a combustion surface of a large area as compared with a Bunsen-type oil burner having a flame source arranged in a ring shape. This causes a mixed gas of a vapor of a fuel oil such as kerosene and air prepared in a mixing chamber which is provided on the rear side of the perforated ceramic plate to be cooled, resulting in the vaporized fuel oil being condensed in the mixing chamber. For the purpose of facilitating revaporization of the condensed fuel oil, the conventional red-hot type oil burner is generally provided at the lower portion thereof with a tray for revaporizing the condensed fuel oil. Such construction, however, is not adapted to allow heat in a combustion chamber disposed on the front side of the ceramic plate to be effectively transmitted to the tray due to convection, conduction and radiation, because the tray is thermally isolated from the combustion chamber by the ceramic plate. Even if the oil burner is constructed to allow heat to be transmitted to the tray due to conduction, the heat is transmitted to only the restricted area of the tray, to thereby cause the temperature distribution of the tray to be nonuniform. This causes a disadvantage of requiring an additional heating means of a large heating capacity in the normal combustion operation as well.

In such conventional red-hot type oil burner, a small amount of combustible gas consisting of a vaporized fuel oil and air, which is previously diluted by an excess air in the mixing chamber, is supplied from the mixing chamber through the perforated ceramic plate to the combustion chamber with a low velocity. This does not permit the combustible gas around an ignition means to easily reach the combustion range at the time of the ignition and results in an explosion of the combustible gas often occurring, because the ignition is accomplished after a large amount of combustible gas has been supplied around the ignition means. Recently, there has appeared on the market a red-hot type oil burner provided therein with a diffusion plate for diffusing the combustible gas. Such construction is suitable for constantly keeping the normal combustion operation, however, it cannot eliminate the above disadvantage encountered during the igniting operation.

The conventional red-hot type oil burner also has a disadvantage of generating a bad odor due to the incomplete combustion of a fuel oil during the ignition operation as well as the fire extinguishing operation. Recently, an oxidation catalyst has remarkably improved in performance, this allowing the generation of bad odor during the fire extinguishing operation to be significantly reduced. However, such catalyst cannot effectively oxidize an incomplete combustion gas generated during the igniting operation which causes the bad odor. In addition, the conventional red-hot type oil burner is not adapted to be heated sufficiently to generate an upward gas flow carrying the bad odor to the ceiling portion of a room to be heated, during the igniting operation. Thus, the bad odor generated during the igniting operation is spread over the room, which cannot be removed unless the room is ventilated, thus preventing the comfortable heating.

It has been conventionally desired that an oil burner is constructed to allow the completion of the igniting and fire extinguishing operations to be surely confirmed. In the prior art red-hot type oil burner, such confirmation has been accomplished by a flame detecting device. The conventional flame detecting device is generally constructed to apply an A.C. voltage between an electrode positioned in a combustion flame and the burner to detect a D.C. current flowing therebetween due to a commutating action of the flame, to thereby ascertain the existence of the flame. Therefore, such device is required to be constructed so that the electrode and the burner may form a current flow path with the combustion flame exhibiting a commutating action. Thus, where the burner is formed of a non-conductive material such as ceramic, it is substantially impossible to detect the flame because such current flow path is not formed. More particularly, in the conventional red-hot type oil burner of a non-conductive material, the flame detecting device is adapted to conduct a flame detection by means of two electrodes respectively positioned in combustion flames which have the substantially same property, therefore, this does not allow a D.C. current to flow between the both electrodes because the flames cannot exhibit a commutating action therebetween, to thereby render the flame detection substantially impossible.

BRIEF SUMMARY OF THE INVENTION

The present invention has been made in view of the foregoing disadvantages encountered with the prior arts.

Accordingly, it is an object of the present invention to provide a red-hot type oil burner capable of effectively accomplishing the uniform vaporization of a fuel oil without utilizing an outer heat source in the normal combustion operation.

It is another object of the present invention to provide a red-hot type oil burner capable of rapidly effecting the ignition with ease and safety without using a pilot flame.

It is another object of the present invention to provide a red-hot type oil burner capable of preventing the generation of a bad odor during the igniting operation as well as the fire extinguishing operation, to thereby allow comfortable heating.

It is a further object of the present invention to provide a red-hot type oil burner capable of surely confirming the completion of the igniting and fire extinguishing operations by exactly detecting the existence of a combustion flame.

According to one aspect of the present invention, there is provided a red-hot type oil burner comprising a hollow vaporization means having a heater which is adapted to vaporize a fuel oil supplied thereto; a mixing means disposed above the vaporization means and communicated thereto, the mixing means being adapted to uniformly mix therein a vaporized fuel oil and an air supplied from the vaporization means thereto to provide a combustible gas; a combustion means disposed adjacent to the mixing means; a perforated ceramic plate provided between the mixing means and the combustion means to communicate the mixing means with the combustion means therethrough; and a heat transfer means for transmitting a part of combustion heat to the vaporization means due to conduction.

According to another aspect of the present invention, a red-hot type oil burner is provided which further comprises a diffusion plate disposed in the mixing means, the diffusion plate upwardly extending from the lower portion of the mixing means and terminating at a position in the mixing means spaced from an upper wall of the mixing means so as to allow the combustible gas to be uniformly distributed with respect to the overall rear surface of the perforated ceramic plate, the diffusion plate being provided with a cutout at the position opposite to an ignition means disposed in the combustion means through the perforated ceramic plate to allow the ignition to be rapidly effected with ease and safety.

According to still another aspect of the present invention, there is provided a red-hot type oil burner further comprising a means for preventing the generation of a bad odor due to an incomplete combustion of the combustible gas during the igniting operation as well as during the fire extinguishing operation, the means comprising an exhaust gas holding chamber disposed above the combustion means and having at least one outlet provided at an upper wall thereof and at least one heat exchange tube upwardly extending between the combustion means and the exhaust gas holding chamber to communicate the combustion means with the exhaust gas holding chamber, the heat exchange tube being disposed not to align with the outlet of the exhaust gas holding chamber.

The present invention further provides a red-hot type oil burner further comprising a combustion flame detecting means disposed in the combustion means which includes a first electrode positioned in the close vicinity of the perforated ceramic plate and electrically connected to the burner and a second electrode adapted to be positioned in the combustion flame and electrically insulated from the burner to detect a current flowing between the two electrodes due to a commutating action of the combustion flame when applying an A.C. voltage between the second electrode and the burner, to thereby allow the combustion flame to be detected.

BRIEF DESCRIPTION OF THE DRAWINGS

These and other objects and many of the attendant advantages of this invention will be readily appreciated as the same becomes better understood by reference to the following detailed description when considered in connection with the accompanying drawings in which like reference numerals designate like or corresponding parts throughout, wherein.

DETAILED DESCRIPTION OF THE PREFERRED EMBODIMENTS

Figure 1:
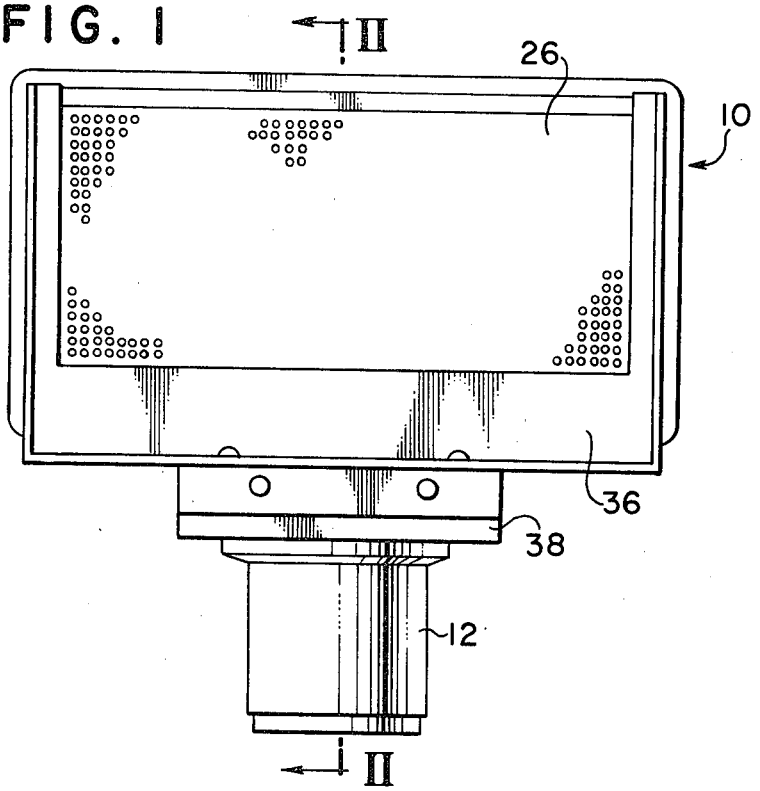
FIG. 1 is a front elevational view showing one embodiment of a red-hot type oil burner according to the present invention.
Figure 2:
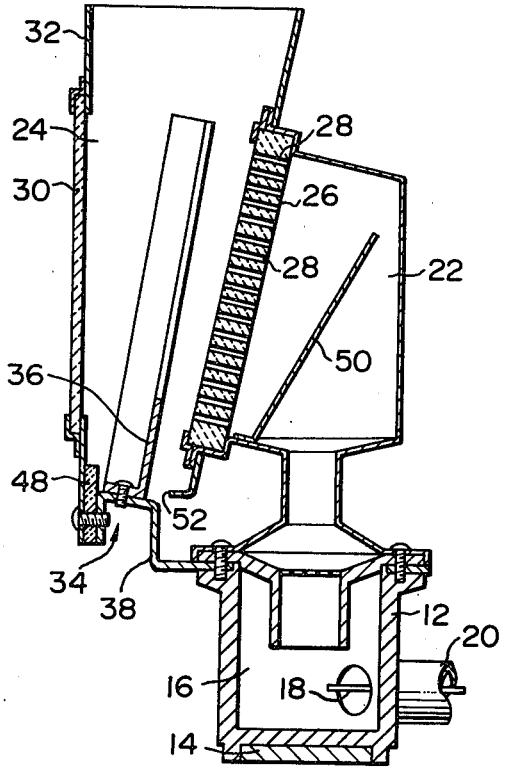
FIG. 2 is a sectional view taken along the line II—II of FIG. 1.

FIGS. 1 and 2 illustrate one embodiment of a red-hot type oil burner according to the present invention in which a red-hot type oil burner is generally indicated by reference numeral 10. The oil burner has a vaporization means 12 provided at the lower portion thereof which is preferably formed of a heat conductive material and provided at the lower portion thereof with a heater 14. In the embodiment the vaporization means 12 is substantially annular in section. The vaporization means 12 defines therein a vaporization chamber 16, which is communicated thereto a pipe 18 for supplying a fuel oil such as kerosene from a fuel oil tank (not shown) and a pipe 20 for supplying an air from an ambient atmosphere. The vaporization chamber 16 acts to heat a fuel oil supplied thereto to vaporize it. The oil burner 10 also has a mixing chamber 22 disposed above the vaporization means 12 and communicated thereto. The mixing chamber 22 is adapted to uniformly mix a vaporized fuel oil and an air supplied from the vaporization chamber 16 thereto to provide a combustible gas. Also, the oil burner 10 has a combustion chamber 24 for burning the combustible gas disposed adjacent to the mixing chamber 22, which is communicated through a perforated ceramic plate 26 to the mixing chamber 22. The ceramic plate 26 is provided with a plurality of small through-holes 28 through which the combustible gas is introduced from the mixing chamber 22 into the combustion chamber 24. The combustion chamber 24 has a heat-resistant and transparent glass plate 30 attached to a front wall 32 thereof through which a radiant heat is outwardly transmitted from the combustion chamber 24 and the ceramic plate 26.

Figure 3:
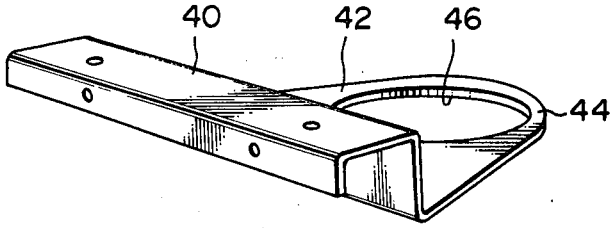
FIG. 3 is a perspective view showing a heat transfer member of a heat transfer means suitable for use in the oil burner shown in FIGS. 1 and 2.

A feature of the red-hot type all burner illustrated is in that a heat transfer means 34 is provided in the oil burner 10 which serves to transfer a part of combustion heat generated in the combustion chamber 24 to the vaporization means 12. The heat transfer means 34 includes a heat absorption member 36 of a heat conductive material such as a metal disposed at the lower portion of the combustion chamber 24. In FIG. 1, the member 36 is positioned opposite to the peripheral portion of a front surface of the ceramic plate 26 so that it does not substantially prevent a radiant heat from being outwardly transmitted through the glass plate 30. The heat transfer means 34 further includes a heat transfer member 38 of a heat conductive material such as a metal which is mechanically and thermally connected to the heat absorption member 36 and which is illustrated in detail in FIG. 3. The heat transfer member 38 has a first plate member 40 and a second plate member 42 which are formed together. The first plate member 40 is adapted to attach therethrough the heat transfer member 38 to the heat absorption member 36 and the front wall 32 of the combustion chamber 24. The second plate member 42 has a substantially annular portion 44 defining an opening 46, the annular portion 44 being formed to be fittedly mounted on the overall upper annular end portion of the vaporization means 12. The vaporization chamber 16 is communicated through the opening 46 to the mixing chamber 22. Therefore, it should be noted that the heat transfer means 34 is constructed to evenly transmit a part of combustion heat to the vaporization means 12 because the heat absorbed by the member 36 is transmitted through the annular portion 44 of the member 38 to the overall vaporization means 12. The mounting of the heat transfer member 38 on the upper end portion of the vaporization means 12 also allows the condensation of a vaporized fuel oil contained in the combustible gas in the mixing chamber 22 to be effectively prevented. However, it should be understood that the second plate member 42 of the heat transfer member 38 may be securely fitted onto the outer periphery of the lower portion of the vaporization means 12 through the opening 46 so as to more effectively accomplish the vaporization of a fuel oil supplied to the vaporization chamber 16.

In the embodiment illustrated, the heat absorption member 36 is formed separate from the heat transfer member 38, however, it is of course possible that the both members may be integrally formed. In addition, in the embodiment the heat transfer member 38 is attached through a heat insulating material 48 to the lower portion of the front wall 32 of the combustion chamber. However, the oil burner may be constructed in such a manner that the lower portion of the front wall 32 is formed of a heat conductive material such as a metal and the first plate member is directly attached to the lower portion of the front wall 32 as well, to thereby transmit to the vaporization means 12 a heat of the lower portion of the front wall 32 as well as a heat absorbed by the member 36.

In the embodiment illustrated, the heat absorption member 36 is substantially U-shaped opposite to the peripheral portion of the perforated ceramic plate 26, however, it may be formed to oppose to only the lower peripheral portion of the ceramic plate. In addition, the heat transfer means 34 may be made up only the heat transfer member 38. In this case, the first plate member 40 is thermally and mechanically connected to the lower portion of the front wall 32 of the combustion chamber which is formed of a heat conductive material.

The mixing chamber 22 may be provided therein with a diffusion plate 50 which serves to uniformly guide the combustible gas in the mixing chamber 22 toward the overall rear surface of the ceramic plate 26. The diffusion plate 50 upwardly extends from the lower portion of the mixing chamber and terminates at a position downwardly spaced from an upper wall of the mixing chamber.

The operation of the red-hot type oil burner as illustrated in FIGS. 1 and 2 will now be explained.

Firstly, the vaporization means 12 is heated by the heater 14. Then, a fuel oil and an air are supplied through the pipes 18 and 20 to the vaporization means 12, respectively. The fuel oil is vaporized in the vaporization chamber 16 heated to a desired temperature by the heater 14 and is partially mixed with the air therein, and subsequently, is supplied to the mixing chamber 22 with the air. The mixture of vaporized fuel oil and air are uniformly mixed in the mixing chamber 22 to form a combustible gas. The combustible gas is evenly distributed with respect to the overall rear surface of the perforated ceramic plate 26 by the diffusion plate 50 and is subsequently introduced through the small through-holes 28 of the ceramic plate 26 into the combustion chamber 24. A flow of combustion air is introduced from an ambient atmosphere through a slit 52 to the combustion chamber to allow the combustible gas to conduct a complete combustion. When the combustible gas is ignited by a suitable ignition means which may be included in the burner 10, it initiates the combustion near the front surface of ceramic plate 26 to render the ceramic plate red-hot by the combustion heat.

During the normal combustion operation of the burner, the vaporization means 12 is evenly heated by a part of the combustion heat transmitted from the combustion chamber and/or the red-hot ceramic plate through the heat transfer means 34 thereto. More particularly, the heat absorption member 36 heated to a high temperature by a part of the combustion heat transmits the heat to the heat transfer member 38 which is subsequently transmits it through the annular portion 44 fittedly mounted on the overall upper annular end portion of the vaporization means, to thereby allow the vaporization means to be evenly heated to a temperature sufficient to supply a vaporized fuel oil required to keep the normal combustion stable. This results in the heating of the vaporization means 22 by the heater 14 being significantly reduced or substantially eliminated during the normal combustion operation. Therefore, the heater 14 may have a positive temperature characteristic thermistor included therein.

Figure 4:
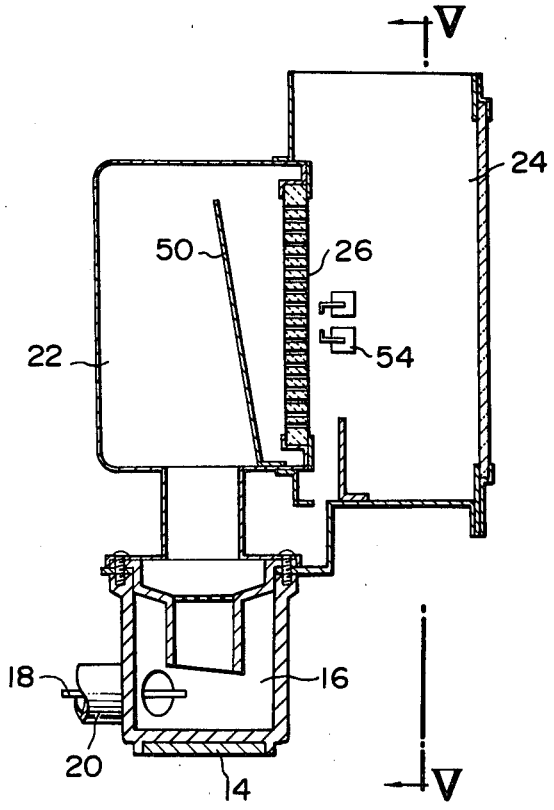
FIG. 4 is a sectional side view showing another embodiment of a red-hot type oil burner according to the present invention.
Figure 5:
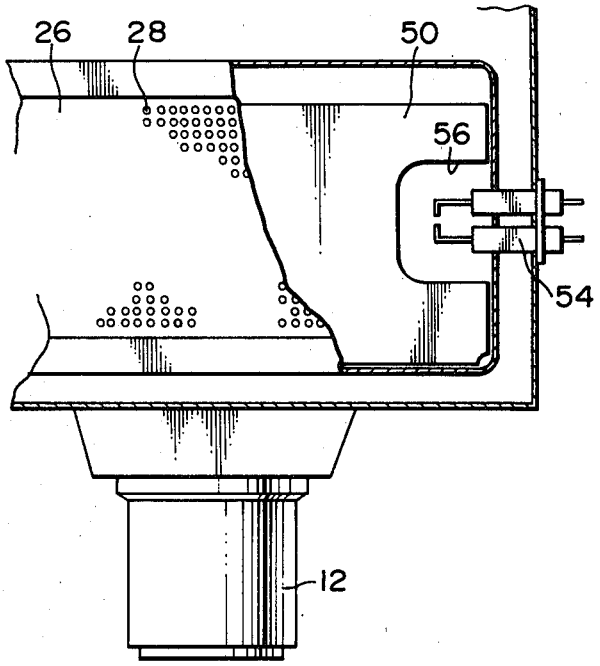
FIG. 5 is a partially cutaway view taken in the direction of the arrows substantially along the line V—V of FIG. 4, wherein a heat transfer means is broken away for clearness.

FIGS. 4 and 5 show another embodiment of a red-hot type oil burner according to the present invention. A red-hot type oil burner 10 of the embodiment is constructed in the substantially same manner as the oil burner illustrated in FIGS. 1 and 2, except that a suitable ignition means 54 such as a piezoelectric spark plug is disposed in a combustion chamber 24 so as to oppose to one side end portion of a perforated ceramic plate 26 and that a diffusion plate 50 disposed in a mixing chamber 22 has a cutout 56 at the portion which is opposite to the ignition means 54 through the ceramic plate 26 interposed therebetween. Therefore, the oil burner of such construction not only allows a combustible gas formed of a vaporized fuel oil and an air in the mixing chamber 22 to be uniformly guided toward the overall rear surface of the ceramic plate 26 but allows the combustible gas to be easily guided through the cutout 56 of the diffusion plate 50 and small through-holes 28 of the ceramic plate 26 in the vicinity of the ignition means 54, to thereby permit the combustion gas around the ignition means to rapidly reach the combustion range during the igniting operation. This results in a time required for igniting the oil burner being much less and explosive combustion being avoided during the igniting operation because the ignition is accomplished before a large amount of combustible gas is introduced into the combustion chamber 24.

It is of course that the cutout 56 desirably has an area enough not to adversely affect the function of the ceramic plate 26. The cutout 56 preferably has an area enough to substantially surround the ignition means 54. Such area does not adversely affect the function of the ceramic plate, the ignition means and the normal combustion operation of the burner.

Figure 6:
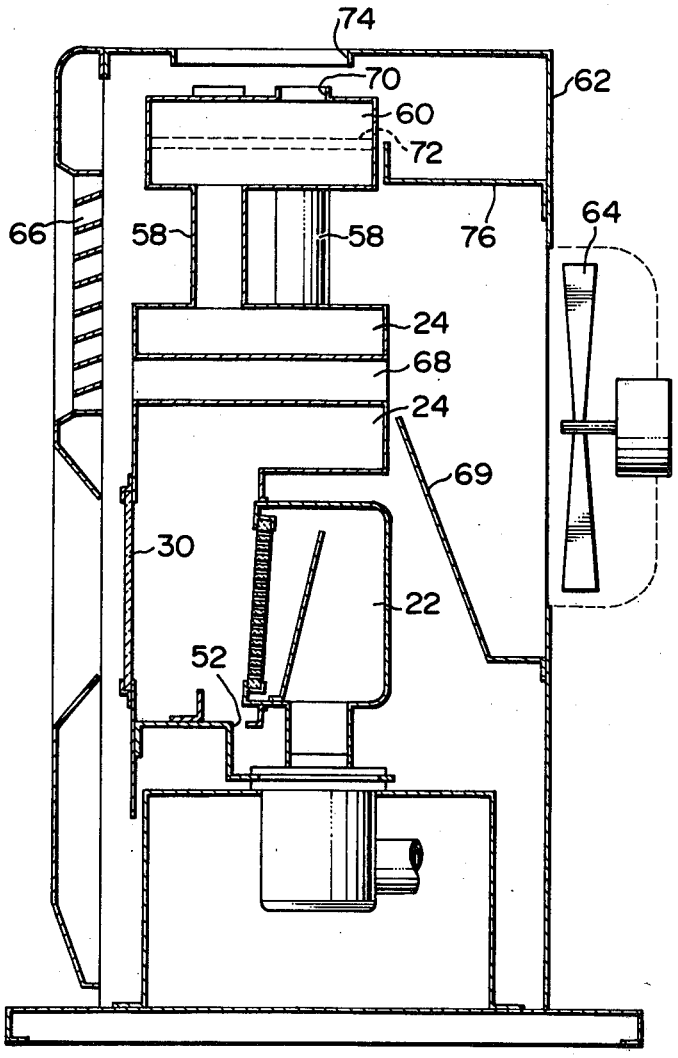
FIG. 6 is a sectional view showing still another embodiment of a red-hot type oil burner according to the present invention.

FIG. 6 shows another embodiment of a red-hot type oil burner according to the present invention. The oil burner illustrated is constructed to exhibit an advantage of preventing the generation of a bad odor during the igniting operation as well as the above-mentioned advantage of the oil burner shown in FIGS. 1 and 2. The oil burner 10 of this embodiment, in addition to such structures as employed in the embodiment of FIGS. 1 and 2, includes at least one heat exchange tube 58 connected to a combustion chamber 24 so as to upwardly extending therefrom and a combustion exhaust gas holding chamber 58 communicated to the upper ends of the tube 60. The oil burner 10 may include a housing 62 for receiving the burner 10, tube 58 and chamber 60 therein. Reference numeral 64 designates a fan for forcedly supplying air from an ambient atmosphere toward the combustion chamber 24 and the heat exchange tube 58. In the embodiment the fan is attached to a rear wall of the housing 62. The heat exchange tube 58 acts to transfer a heat of an exhaust gas upwardly flowing therethrough to the chamber 60 to air introduced into the housing 62 by the fan 64, to thereby significantly lower the temperature of the chamber 60 as compared with the temperature of the combustion chamber 24 and render the air warm. The warmed air is discharged from an air outlet 66 provided at a front wall of the housing 62. For the purpose of more effectively accomplishing the heat exchange, the combustion chamber 24 may be provided at the upper portion thereof with an air duct 68 which is airtightly isolated from the interior of the combustion chamber and is adapted to flow therethrough a part of an air supplied by the fan 64. However, it is of course that even after the exhaust gas has passed through the tube 58, it has a considerably high temperature as compared with an ambient atmosphere. In addition, the housing 62 is preferably provided therein with a control plate 69 to direct an air introduced therein toward the tubes 58 and 68 and to prevent the air from cooling mixing chamber 22. It should be noted that the oil burner is also adapted to outwardly transmit a radiant heat from the combustion chamber through a glass plate 30.

The exhaust gas holding chamber 60 serves to temporarily hold therein an exhaust gas introduced from the combustion chamber 24 through the tube 58 thereinto. The chamber 60 is provided at an upper wall thereof with at least one outlet 70, which is preferably disposed not to align with the heat exchange tube 58 in order to hold the exhaust gas within the chamber 60 as long as possible. For the same purpose, it is preferable that the chamber 60 is provided therein with an exhaust gas retaining means 72 such as a honeycomb ceramic plate, a glass-wool, a perforated metal sheet or the like. In addition, for the purpose of cleaning an exhaust gas, a catalyst such as an oxidation catalyst may be supported on the retaining means 72 and/or walls of the chamber 60.

The operation of the oil burner of this embodiment will be explained hereinafter in view of the prevention of bad odor.

When the oil burner 10 is ignited, a combustion exhaust gas containing unburned hydrocarbon gas therein is guided from the combustion chamber 24 through the heat exchange tube 58 to the exhaust gas holding chamber 60 and diffuses therein. At this time, the chamber 60 is not yet heated, therefore, hydrocarbon gas of a high or medium molecular weight causing a bad odor which is contained in the exhaust gas contacts the walls of the chamber 60 and the exhaust gas retaining means 72 to condense as droplets thereon or is retained in the chamber 60. While, hydrocarbon gas of a low molecular weight contained in the exhaust gas is discharged from the chamber 60 through the outlet 70 and an opening 74 provided at an upper wall of the housing 62 to the exterior thereof. However, this does not substantially cause a bad odor because of the low molecular weight. When the oil burner 10 reaches the normal combustion state, the chamber 60 is heated to a relatively high temperature to allow the hydrocarbon condensed and retained in the chamber 60 to be decomposed to change to an odorless gas, which is discharged through the outlet 70 and opening 74. In the normal combustion state, the oil burner forms an upward gas flow which allows the exhaust gas to be carried to the ceiling portion of a room to be heated. Therefore, even if the condensed hydrocarbon is vaporized without being decomposed, it does not substantially cause a bad odor during the normal combustion operation. In this connection, if the oxidation catalyst is carried on the exhaust gas retaining means 72 and/or the walls of the chamber 60, the condensed and retained hydrocarbon may be effectively decomposed and burned. Such catalyst also allows hydrocarbon gas generated in the fire extinguishing operation to be oxidized to prevent the generation of a bad odor during the operation because the catalyst is still kept at a high temperature. In addition, where a windshield plate 76 is provided adjacent to the chamber 60 in the housing 62 to prevent an air supplied by the fan 64 from cooling the chamber 60, the chamber 60 may be kept at a higher temperature sufficient to more effectively burn unburned hydrocarbon.

It is of course possible that the mechanism for preventing the generation of a bad odor employed in this embodiment may be incorporated in the oil burner shown in FIGS. 4 and 5.

Figure 7:
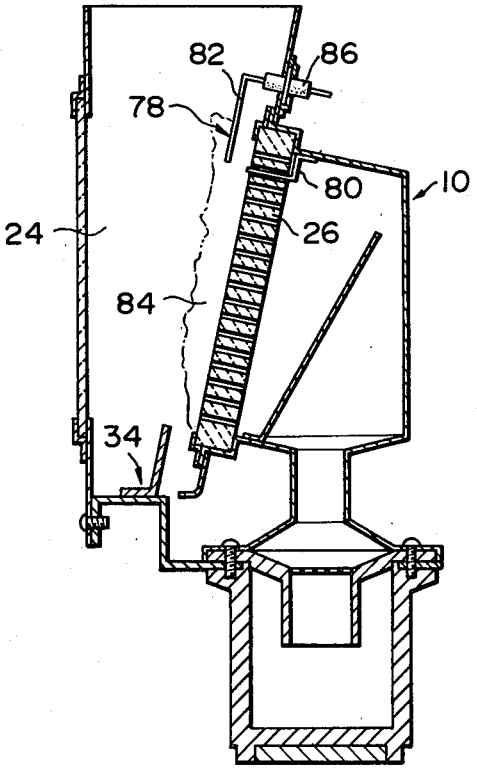
FIG. 7 is a sectional side view showing a further embodiment of a red-hot type oil burner according to the present invention.

FIG. 7 shows a further embodiment of a red-hot type oil burner according to the present invention. The oil burner of the embodiment is constructed in the substantially same manner as the oil burner shown in FIGS. 1 and 2 with the exception that it has a means for confirming the completion of the igniting and fire extinguishing operations. Such means is generally designated by reference numeral 78 and comprises a first electrode 80 and a second electrode 82. The first electrode 80 is electrically connected to the oil burner 10 so as to have the same potential as the burner, while, the second electrode 82 is electrically insulated with respect to the burner 10. In addition, the first electrode 80 is positioned in the close vicinity of a front surface of a perforated ceramic plate 26 and the second electrode 82 is positioned to be surrounded by a combustion flame 84; therefore, it will be seen that during the combustion operation of the burner the electrodes 80 and 82 are adapted to be respectively surrounded by flames different in property from each other irrespective of the degree of combustion.

Thus, when an A.C. voltage is applied between the burner 10 and the second electrode 82 during the combustion operation, a current flows between the electrodes 80 and 82 due to a commutating action of the combustion flame 84 which is sufficient to detect the flame irrespective of the degree of combustion, while, the application of an A.C. voltage between the burner and the second electrode in the uncombustion state of the burner does not permit a current to flow between the electrodes 80 and 82; this allowing the igniting and fire extinguishing of the burner 10 to be surely confirmed. Reference numeral 86 designates an insulating material.

It is of course possible that the means 78 for confirming the igniting and fire extinguishing of a burner employed in this embodiment may be incorporated in the oil burners shown in FIGS. 4 and 5 and FIG. 6, respectively.

While preferred embodiments of the invention have been described with a certain degree of particularity, obvious modifications and variations are possible in light of the above teachings. It is therefore to be understood that within the scope of the appended claims, the invention may be practiced otherwise than as specifically described.

What is claimed is:

1. A red-hot type oil burner, comprising:

a hollow vaporization means, including a heating element, for vaporizing fuel oil supplied thereto;

mixing means, disposed above and communicated with said vaporization means, for uniformly mixing vaporized fuel oil and air supplied thereto from said vaporization means to provide a combustible mixture;

a combustion chamber disposed adjacent to said mixing means, said combustion chamber comprising a wall including a perforated ceramic plate means for allowing passage of said combustible mixture from said mixing means to said combustion chamber; and a heat absorption member of heat conductive material, said heat absorption member having one end extended to said combustion chamber and another end, said other end having an open portion through which said vaporization means extends, said open portion being fittedly attached and thermally connected to said vaporization means, said heat absorption member thereby comprising means for evenly conducting a part of the combustion heat to said vaporization means whereby normal combustion is stabilized in said combustion chamber.

2. A red-hot type oil burner as defined in claim 1, wherein said heat absorption member has one end disposed adjacent to said perforated ceramic plate in said combustion chamber and the other end connected to said vaporization means, the other end of said heat absorption member being provided with a portion having an opening through which said heat absorption member is fittedly mounted on the overall upper end portion of said vaporization means.

3. A red-hot type oil burner as defined in claim 2, wherein said one end of said heat absorption member is positioned adjacent to the peripheral portion of said perforated ceramic plate.

4. A red-hot type oil burner as defined in claim 3, wherein said one end of said heat absorption member is substantially U-shaped.

5. A red-hot type oil burner as defined in claim 2, wherein said one end of said heat absorption member is positioned adjacent to the lower portion of said perforated ceramic plate.

6. A red-hot type oil burner as defined in claim 1, wherein said heat absorption member has one end disposed adjacent to said perforated ceramic plate in said combustion chamber and the other end connected to said vaporization means, the other end of said heat absorption member being provided with a portion having an opening through which said heat transfer means is fittedly attached to an outer periphery of said vaporization means.

7. A red-hot type oil burner as defined in claim 1, wherein said heat absorption member is connected at one end thereof to a front wall of said combustion chamber and at the other end thereof to said vaporization means, the other end of said heat absorption member being provided with a portion having an opening through which said heat absorption member is fittedly mounted on the overall upper end portion of said vaporization means.

8. A red-hot type oil burner as defined in claim 1 further comprising a diffusion plate disposed in said mixing means, said diffusion plate upwardly extending from the lower portion of said mixing means and terminating at a position downwardly spaced from an upper wall of said mixing means so as to uniformly distribute said combustible gas with respect to the overall rear surface of said perforated ceramic plate, said diffusion plate being provided with a cutout at the position opposite to an ignition means provided in said combustion chamber through said perforated ceramic plate.

9. A red-hot type oil burner as defined in claim 8, wherein said cutout is provided at one side portion of said diffusion plate.

10. A red-hot type oil burner as defined in claim 1 further comprising a means for preventing the generation of a bad odor which comprises an exhaust gas holding chamber disposed above said combustion chamber and having at least one outlet provided at an upper wall thereof and at least one heat exchange tube upwardly extending between said combustion chamber and said exhaust gas holding chamber to communicate said combustion chamber with said exhaust gas holding chamber, said outlet and said heat exchange tube being disposed not to align with each other.

11. A red-hot type oil burner as defined in claim 10, wherein said exhaust gas holding chamber is provided therein with an exhaust gas retaining member.

12. A red-hot type oil burner as defined in claim 10 further comprising a housing for receiving therein said burner and said means for preventing the generation of a bad odor, said housing having an outlet provided at an upper wall thereof to discharge an exhaust gas from said outlet of said exhaust gas holding chamber to the exterior thereof, a fan for supplying air from an ambient atmosphere thereinto to warm said air by said heat exchange tube and an air outlet provided at a front wall thereof to discharge the warmed air to the exterior thereof.

13. A red-hot type oil burner as defined in claim 10, wherein said combustion chamber is provided at the upper portion thereof with an air duct which is airtightly isolated from the interior thereof and is capable of passing an ambient atmosphere therethrough.

14. A red-hot type oil burner as defined in claim 1 further comprising a combustion flame detecting means disposed in said combustion chamber which comprises a first electrode positioned in the close vicinity of said perforated ceramic plate and electrically connected to said burner and a second electrode adapted to be positioned in a combustion flame and electrically insulated from said burner to detect a current flowing between said first and second electrodes due to a commutating action of said combustion flame when applying an A.C. voltage between said burner and said second electrode, to thereby allow said combustion flame to be detected.

15. A red-hot type oil burner as defined in claim 14, wherein said first electrode is inserted through said perforated ceramic plate into said combustion chamber.

16. A red-hot type oil burner as defined in claim 6, wherein said heat absorption member is attached to an outer periphery of the upper portion of said vaporization means.

17. A red-hot type oil burner comprising a vaporization chamber annular in cross section having a heater attached to the lower portion thereof which is adapted to vaporize a fuel oil supplied thereto; a mixing chamber disposed above said vaporization chamber and communicated thereto for uniformly mixing therein a vaporized fuel oil and an air supplied from said vaporization chamber thereto to provide a combustible gas; a combustion chamber disposed adjacent to said mixing chamber for burning said combustible gas; a perforated ceramic plate substantially rectangular in shape provided between said mixing chamber and said combustion chamber to allow said combustible gas to be introduced through a plurality of small through-holes thereof from said mixing chamber into said combustion chamber; a heat transfer means provided in said combustion chamber for transmitting a part of combustion heat to said vaporization chamber due to conduction; said mixing chamber having a diffusion plate disposed therein which upwardly extends from the lower portion of said mixing chamber and terminates at a position downwardly spaced from an upper wall of said mixing chamber so as to uniformly distribute said combustible gas with respect to a rear surface of said perforated ceramic plate; said combustion chamber being adapted to initiate the combustion of said combustible gas in the close vicinity of a front surface of said perforated ceramic plate to render said ceramic plate red-hot; said heat transfer means having one end disposed adjacent to the front surface of said ceramic plate and formed in a substantially U-shape so as to oppose to the peripheral portion of said ceramic plate and the other end provided with a substantially annular portion to be fittedly mounted to the overall annular upper end portion of said vaporization chamber.

* * * * *